US005404640A

United States Patent [19]

Himmeroeder

[11] Patent Number: 5,404,640

[45] **Date of Patent: * Apr. 11, 1995**

[54] METHOD OF FORMING TOOTHED WHEELS

[75] Inventor: Helge Himmeroeder, Barrie, Canada

[73] Assignee: Tesma International Inc., Markham, Canada

[ * ] Notice: The portion of the term of this patent subsequent to Oct. 6, 2009 has been disclaimed.

[21] Appl. No.: 47,408

[22] Filed: Apr. 19, 1993

Related U.S. Application Data

[60] Continuation-in-part of Ser. No. 925,388, Aug. 26, 1992, Pat. No. 5,237,744, which is a continuation-in-part of Ser. No. 837,399, Feb. 19, 1992, Pat. No. 5,152,061, and Ser. No. 925,775, Aug. 7, 1992, Pat. No. 5,203,223, which is a division of Ser. No. 837,399, Feb. 19, 1992, Pat. No. 5,152,061.

[51] Int. Cl.[6] ..... B21D 53/28

[52] U.S. Cl. ..... 29/893.32; 72/68; 74/449; 74/457; 74/460

[58] Field of Search ..... 29/893.32, 892.3; 72/68, 102, 107, 109, 110; 74/438, 449, 457, 460

[56] References Cited

U.S. PATENT DOCUMENTS

| | | | |
|---|---|---|---|
| 4,027,376 | 6/1977 | Brinkman | 29/893.35 |
| 5,152,061 | 10/1992 | Himmeroeder | 29/893.32 |
| 5,237,744 | 8/1993 | Himmeroeder | 29/893.32 |

FOREIGN PATENT DOCUMENTS

| | | | |
|---|---|---|---|
| 3311528 | 10/1983 | Germany | 29/893.35 |

*Primary Examiner*—P. W. Echols

*Attorney, Agent, or Firm*—Cushman, Darby & Cushman

[57] ABSTRACT

A method is provided for forming a one-piece sheet metal toothed wheel including a central sheet metal wall of predetermined thickness and a series of integral teeth on the periphery of the central wall.

The method comprises a combination of steps the initial one is cold-forming a circular piece of sheet metal into a preform having an outer annular section of generally uniform cross-sectional configuration and an integral sheet metal central wall.

The next step is rotating (1) the rotary holding unit with the preform secured thereto about the preform axis, and (2) the tooth-forming tool unit about the rotational axis thereof in a predetermined rotational relation wherein the axes are parallel and the rotational speeds are synchronized. The third step is performed while the rotary holding unit with the preform secured thereto and the tooth-forming tool unit are in the predetermined rotational relation, effecting a relative movement between the units and the axes thereof in a direction toward one another to engage the tooth-forming periphery of the tooth-forming tool unit in cooperating metal-deforming relation until the sheet metal of the outer portion of the annular section is cold-formed into a series of initially-formed teeth, peripheries of the series of initially-formed teeth being cold-formed by rolling contact with the tooth-forming periphery of the tooth-forming tool unit. Each of the initially-formed teeth has a pair of oppositely disposed operative surfaces defined between a crest portion and a trough portion. The final step is to form the series of integral teeth by removing material from the pair of operative surfaces.

28 Claims, 5 Drawing Sheets

Fig. 13.
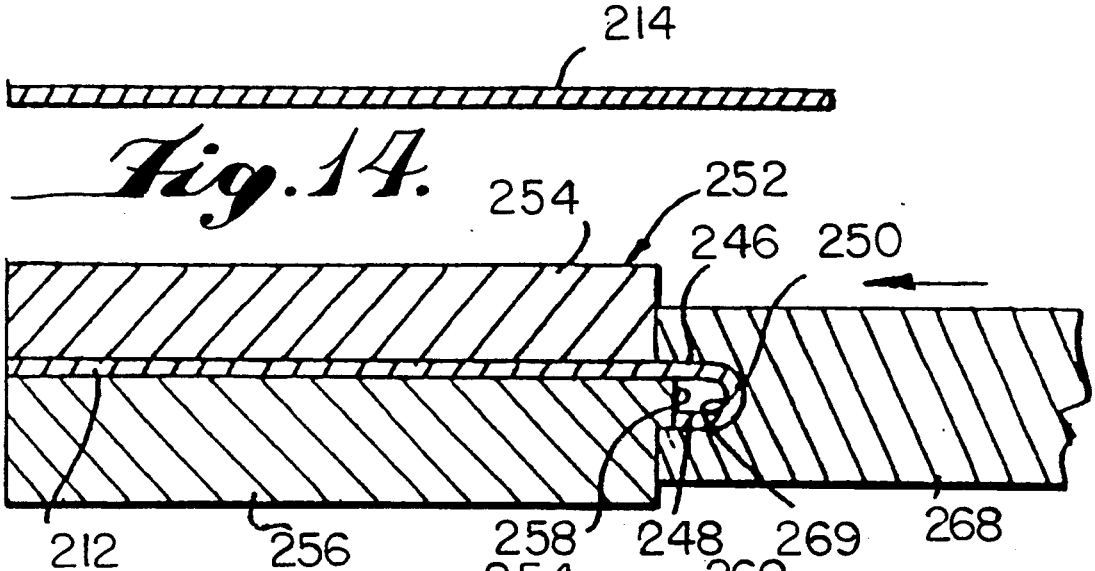
Fig. 14.
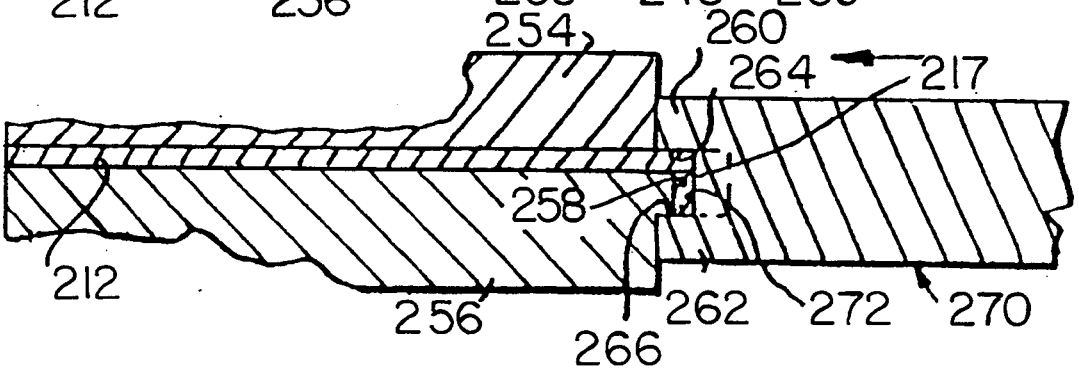
Fig. 15.

METHOD OF FORMING TOOTHED WHEELS

This application constitutes a continuation-in-part of my U.S. patent application Ser. No. 07/935,388, filed Aug. 26, 1992, now U.S. Pat. No. 5,237,744, entitled Method of Cold-Forming Tooth Wheels, in turn, a continuation-in-part of application Ser. No. 07/837,399, filed Feb. 19, 1992, now U.S. Pat. No. 5,152,061, which issued Oct. 6, 1992, and of my application Ser. No. 07/925,775, filed Aug. 7, 1992, now U.S. Pat. No. 5,203,223, entitled Cold-Forming of Toothed Wheels from Sheet Steel, in turn, a Rule 60 division of application Ser. No. 07/837,399, now filed Feb. 19, 1992, now U.S. Pat. No. 5,152,061, which issued Oct. 6, 1992, the disclosures of which are hereby incorporated by reference into the present specification.

This invention relates to toothed wheels of the type utilized in motor vehicles as, for example, in the starter assembly thereof and more particularly to improvements in the method of making such toothed wheels.

In Applicant's U.S. Pat. No. 5,203,223, there is disclosed a method of forming a toothed wheel including a series of cold-formed peripheral teeth having sides spaced apart a predetermined distance utilizing (1) a rotary holding unit having structure providing a generally radially outwardly facing control surface and (2) a rotary tooth-forming tool unit having a rotational axis and a tooth-forming periphery extending annularly about the rotational axis. One of the rotary units includes two annular flanges extending outwardly thereof having two smooth tooth-side forming surfaces facing toward one another spaced apart the predetermined distance. The method of U.S. Pat. No. 5,203,223 comprises the initial step of cold-forming a circular piece of sheet metal of predetermined thickness into a preform having an outer annular section of generally uniform cross-sectional configuration and an integral sheet metal central wall generally of the predetermined thickness extending annularly inwardly from the outer annular section toward a preform axis, the outer annular section having (1) a width greater than the predetermined thickness but no greater than the predetermined distance, and (2) an outer periphery which will allow a meshing action with the tooth-forming periphery of the tooth-forming tool unit. The method of U.S. Pat. No. 5,203,223 also includes the step of rotating (1) the rotary holding unit with the preform secured thereto about the preform axis and with the control surface underlying at least a portion of the annular section and (2) the tooth-forming tool unit about the rotational axis thereof in a predetermined rotational relation wherein the axes are parallel and the rotational speeds are synchronized. While the rotary holding unit with the preform secured thereto and the tooth-forming tool unit are in the predetermined rotational relation, the method of U.S. Pat. No. 5,203,223 further includes the step of effecting a relative movement between the units and the axes thereof in a direction toward one another to engage the tooth-forming periphery of the tooth-forming tool unit in cooperating metal-deforming relation with the annular section inwardly of the exterior periphery thereof until the sheet metal of the annular section is cold-formed into the series of teeth, the peripheries of which are cold-formed by rolling contact with the tooth-forming periphery of the tooth-forming tool unit and portions of the sides of which are smooth and cold-formed by contact with the smooth tooth-side forming surface so that an amount of sheet metal which would otherwise uncontrollably flow axially outwardly of the smooth tooth-side forming surfaces is concentrated within the teeth and/or the radially inward back-up therefor.

It has been found that, while the total confinement of the metal during the cold-forming operation has the advantages stated, there also existed a tendency to break teeth off of the rotary tooth-forming tool unit after a period of operation which, on occasion, would be substantially less than the normal expected operative life of the tool unit. The frequency of tooth failure was considered unexpected particularly in the tool construction where the two annular flanges for forming the two smooth tooth sides were integrally interconnected on opposite sides of the forming teeth.

Thus, U.S. Pat. No. 5,237,744 discloses a method to overcome the problem of frequency of tooth failure in the rotary tooth forming unit of the above described method of application Ser. No. 07/925,775. The method of U.S. Pat. No. 5,203,223 comprises forming a one-piece sheet metal toothed wheel including a central sheet metal wall of predetermined thickness and a series of cold-formed integral teeth on the periphery of the central wall defined by troughs extending radially inwardly therebetween to a cylindrical trough plane concentric with an axis of the central wall, the series of cold-formed integral teeth having an operative width defined by spaced tooth side defining planes. The method utilizes (1) a rotary holding unit which in holding operation provides an inner pair of opposed central wall-engaging surfaces extending generally radially outwardly to a cylindrical inner plane spaced inwardly from an outer cylindrical plane of a size equal to the trough plane and an outer pair of back-up surfaces extending from the inner pair of opposed central wall-engaging surfaces at the inner plane to the outer plane where the outer pair of surfaces are spaced apart a predetermined distance which is greater than the spacing between the inner pair of surfaces so as to define a back-up space within an annulus between the inner and outer planes and (2) a rotary tooth-forming tool unit having a rotational axis and a tooth-forming periphery extending annularly about the rotational axis. The method comprises a combination of steps the initial one of which is cold-forming a circular piece of sheet metal into a preform having an outer annular section of generally uniform cross-sectional configuration and an integral sheet metal central wall generally of the predetermined thickness extending generally radially inwardly from the outer annular section toward a preform axis. The outer annular section has (1) a width greater than the predetermined thickness but no greater than the predetermined distance, and (2) an outer periphery extending beyond the trough plane which will allow a meshing action with the tooth-forming periphery of the tooth-forming tool unit. The next step is rotating (1) the rotary holding unit with the preform secured thereto about the preform axis and an inner portion of the outer annular section within the back-up space and an outer portion of the outer annular section extending radially outwardly of the back-up space, and (2) the tooth-forming tool unit about the rotational axis thereof in a predetermined rotational relation wherein the axes are parallel and the rotational speeds are synchronized. The third step is performed while the rotary holding unit with the preform secured thereto and the tooth-forming tool unit are in the predetermined rotational relation affecting a relative movement between the units and the axes thereof in a direction toward one another to engage the tooth-forming periphery of the tooth-forming tool unit in cooperating metal-deforming relation with the outer portion of the outer annular section inwardly of the exterior periphery thereof until the sheet metal of the outer portion of the annular section is cold-formed into the series of teeth and displaced from the troughs therebetween so that after the series of teeth are cold-formed the toothed wheel includes a back-up portion having surfaces conforming to an outer extent of each of the outer pair of surfaces defining the back-up space, the peripheries of the series of teeth being cold-formed by rolling contact with the tooth-forming periphery of the tooth-forming tool unit and the sides of the series of teeth including portions disposed outwardly beyond the spaced tooth side defining planes being free-formed without surface contact by the axially outward movement of the metal defining the outer portion of the outer annular section.

It has been found that, when cold-forming the final series of teeth by the above-mentioned methods, it is difficult to accommodate build-up of material on both sides of the teeth being formed. Further, the dimensional precision of teeth that are cold-formed may be diminished, since tight tolerances are difficult to achieve.

An object of the present invention is to overcome the difficulty in accurately cold-forming teeth for a tooth wheel. In accordance with the principles of the present invention, this objective is achieved by providing a method of forming a one-piece sheet metal toothed wheel including a central sheet metal wall of predetermined thickness and a series of integral teeth on the periphery of the central wall. The method utilizes (1) a rotary holding unit, and (2) a rotary tooth-forming tool unit having a rotational axis and a tooth-forming periphery extending annularly about the rotational axis. The method comprises a combination of steps, the initial one of which is cold-forming a circular piece of sheet metal into a preform having an outer annular section of generally uniform cross-sectional configuration and an integral sheet metal central wall generally of the predetermined thickness extending generally inwardly from the outer annular section toward a preform axis. The outer annular section has (1) a width greater than the predetermined thickness, and (2) an outer periphery which will allow a meshing action with the tooth-forming periphery of the tooth-forming tool unit. The next step is rotating (1) the rotary holding unit with the preform secured thereto about the preform axis, and (2) the tooth-forming tool unit about the rotational axis thereof in a predetermined rotational relation wherein the axes are parallel and the rotational speeds are synchronized. The third step is performed while the rotary holding unit with the preform secured thereto and the tooth-forming tool unit are in the predetermined rotational relation, effecting a relative movement between the units and the axes thereof in a direction toward one another to engage the tooth-forming periphery of the tooth-forming tool unit in cooperating metal-deforming relation until the sheet metal of the outer portion of the annular section is cold-formed into a series of initially-formed teeth, the peripheries of the series of initially-formed teeth being cold-formed by rolling contact with the tooth-forming periphery of the tooth-forming tool unit. Each of the initially-formed teeth has a crest portion, a trough portion and a pair of oppositely disposed operative surfaces defined between the crest portion and the trough portion. The final step is to form the series of integral teeth by removing material from the pair of operative surfaces.

Another object of the present invention is to provide a method of forming a toothed wheel which is cost effective.

These and other objects of the present invention will become more apparent during the course of the following detailed description and appended claims.

The invention may best be understood with reference to the accompanying drawings wherein an illustrative embodiment is shown.

IN THE DRAWINGS

FIGS. 13–15 are views similar to FIGS. 2–6 illustrating steps in still another embodiment of the method of the present invention.

Figure 1:
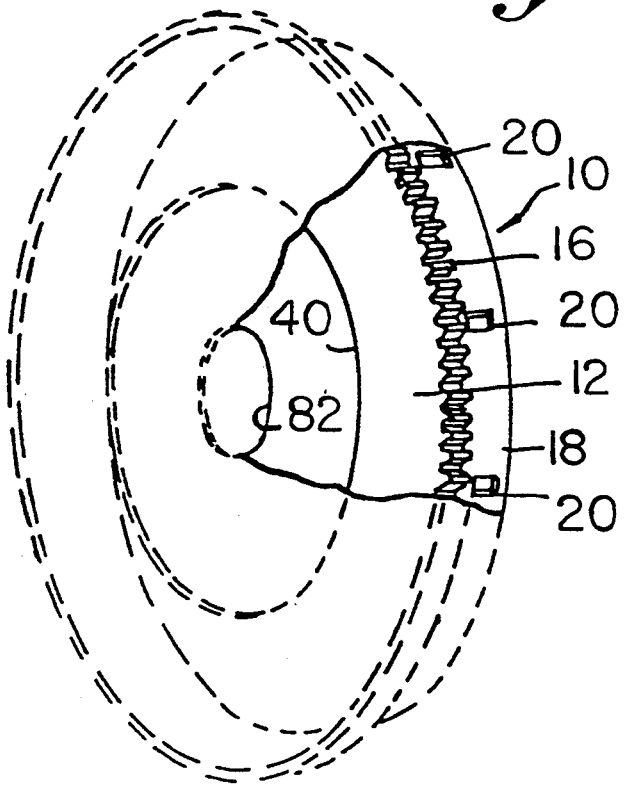
FIG. 1 is a perspective view partly in solid lines and partly in dotted lines of a starter gear with an integral pulse ring constructed in accordance with the method of the present invention.
Figure 2:
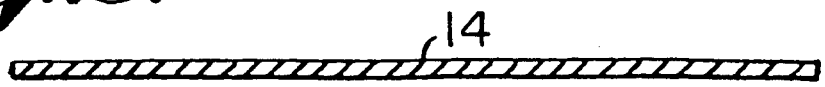
FIG. 2 is a fragmentary sectional view of one-half of a circular piece of sheet metal which constitutes the starting material in practicing the principles of the present invention.

Referring now more particularly to FIGS. 1–9, there is shown therein a toothed wheel in the form of a starter gear, generally indicated at 10, constructed in accordance with the principles of the present invention. FIGS. 2–6 illustrate various steps in the method of making the starter gear 10 in accordance with one embodiment of the method of the present invention. As shown, the starter gear 10 is made from a single circular piece of sheet metal, as, for example, steel capable of being cold-formed. As best shown in FIG. 1, the starter gear 10 includes a central wall 12 of sheet metal having a thickness generally equal to the predetermined thickness of the sheet metal which forms the starting material. FIG. 2 illustrates in cross-section one-half of a circular piece of sheet metal 14 the formation of which constitutes a first step in the method of the present invention.

The starter gear 10 also includes an annular section formed integrally with the outer periphery of the central wall 12, a portion of which defines a series of gear teeth 16 and a portion of which defines pulse ring 18 in the form of an axially extending cylindrical flange having a series of openings 20 extending radially therethrough at regular intervals. As shown, there are twelve openings 20 equally spaced annularly about the axis of the starter gear 10 with each opening 20 being of generally rectangular configuration.

Figure 3:
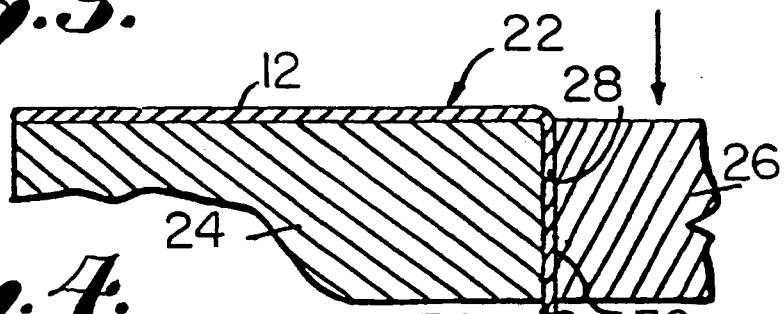
FIG. 3 is a view similar to FIG. 2 illustrating a first step in the process of the present invention wherein the circular piece of sheet metal is cold-formed into a can.

Referring now more particularly to FIG. 2, the circular piece of sheet metal 14 is illustrated therein to be a separate piece which may be stamped from a continuous sheet of steel. It will be understood that the separation of the circular starting piece 14 from a roll or continuous web of sheet material need not be accomplished in a single step wherein the circular piece 14 is produced for subsequent handling but may be only transitionally formed as a part of a multi-step sequence in the method. For example, the circular piece 14 could be a transitional part in the step of cold-forming a can 22. However, as shown in FIG. 3, the circular piece of sheet metal 14 is placed over a circular support 24 and a die 26 having a cylindrical opening 28 therein is moved axially so as to engage an outer annulus of the circular piece 14 and cold-form the outer annulus into a flange 30 extending axially from the outer periphery of a central wall 12 thereof.

Figure 4:
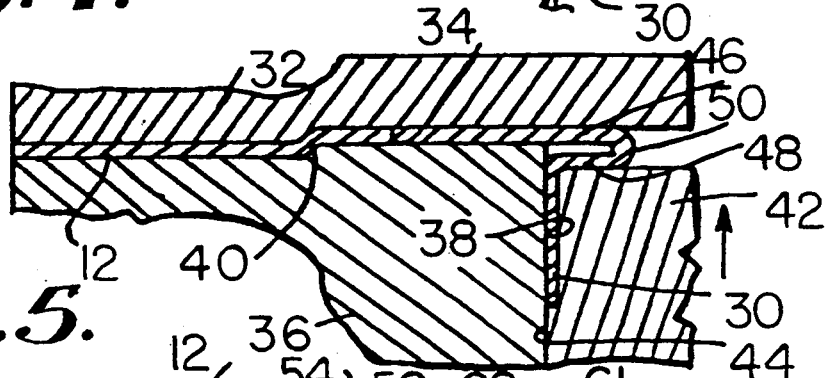
FIG. 4 is a view similar to FIG. 3 showing the next step in the method of the present invention including the formation of an annular section from the can.

Next, as shown in FIG. 4, the can 22 is placed so that the central wall 12 is in abutment with a support 32 having an annular recess 34 therein and a central plunger 36, which has an exterior cylindrical periphery 38 sized to engage within the axial flange 30 of the can 22, is moved toward the support 32 so as to form the central wall 12 of the can 22 with a central recess therein defined by an annular shoulder 40. A second outer annular plunger 42 is then moved toward the support 32 and the plunger 42 has an interior periphery 44 which is of notched cylindrical configuration so as to engage both the exterior surface and the end surface of the axial flange 30 of the can 22.

During the movement of the outer annular plunger 42 toward the support 32, the portion of the axial flange 30 adjacent the central wall 12 is bulged out so as to form two annular side-by-side wall portions 46 and 48, one of which is integral at its inner periphery with the outer periphery of the center wall 12 and the other of which is integral at its inner periphery with the adjacent end of the remaining portion of the axial flange 30. The outer periphery of both annular wall sections 46 and 48 are integrally interconnected as indicated at 50. At the end of these procedures, the original circular piece of sheet metal 14 has now been cold-formed into a non-thickened preform which includes the center wall 12 having an outer annular section integral with the outer periphery thereof, which includes the two side-by-side annular wall portions 46 and 48 and the remaining portion of the axial flange 30.

Figure 5:
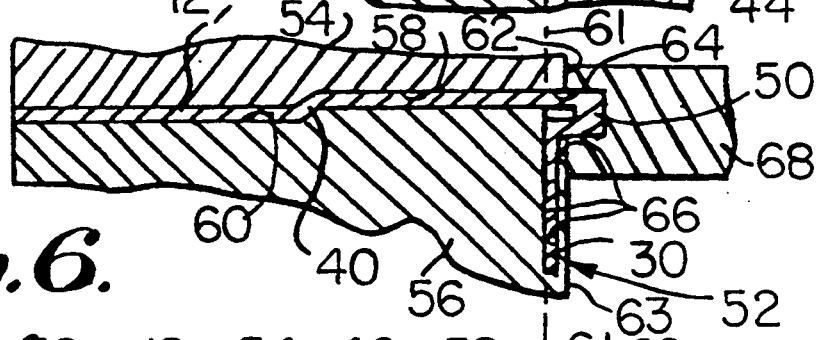
FIG. 5 is a view similar to FIG. 4 showing the next step in the method of the present invention wherein a final preform is cold-formed by thickening the annular section.

Referring now more particularly to FIG. 5, the unthickened preform is next secured with a rotary holding unit, generally indicated at 52, which includes a pair of complementary annular holding members 54 and 56. As shown in FIG. 5, the complementary holding members 54 and 56 provide, when in operative holding relation, an inner pair of opposed central wall engaging surfaces 58 and 60, respectively, which are spaced axially apart a distance equal to the predetermined thickness of the central wall 12 so as to allow the central wall 12 to be engaged therebetween. As shown in FIG. 5, the inner pair of opposed surfaces 58 and 60 extend generally radially outwardly to an inner cylindrical plane, indicated by the phantom line 61 in FIGS. 5 and 6, which is spaced inwardly from a pair of exterior peripheral surfaces 62 and 63 on the holding members 54 and 56 respectively.

The complementary holding members 54 and 56 also have an outer pair of back-up surfaces 64 and 66, respectively, extending from the inner pair of opposed central wall engaging surfaces 58 and 60 respectively, to exterior peripheral surfaces 62 and 63, respectively. The peripheral surfaces 62 and 63 define a cylindrical plane concentric with the axis of the central wall 12. The outer extent of the surfaces 64 and 66 extend generally radially to the peripheral surfaces 62 and 63 in axially spaced relation. The axial spacing between the outer pair of surfaces 64 and 66 at the outer plane is a predetermined distance greater than the predetermined thickness of the central wall 14. It will also be noted that the surfaces 64 and 66 define a back-up space which is disposed within the annulus between the inner cylindrical plane 61 and the cylindrical outer plane.

In the operative secured relation of the holding members 54 and 56 with the non-thickened preform, the central wall 12 is engaged between the inner pair of opposed surfaces 58 and 60 and the flange 30 is engaged within the back-up space defined by the surface 66. The non-thickened preform thus secured in the rotary holding unit 52 is then cold-formed into a final thickened preform by moving a rotary thickening tool 68 radially inwardly into engagement with the connection 50 at the outer periphery of the annular wall portions 46 and 48 of the non-thickened preform while the rotary holding unit 52 is rotated to thus cold-form the outer periphery of the annular section radially inwardly into a configuration wherein the integral connection 50 between the two annular wall portions 46 and 48 is thickened as well as the adjacent portions of the annular wall portions themselves.

Figure 7:
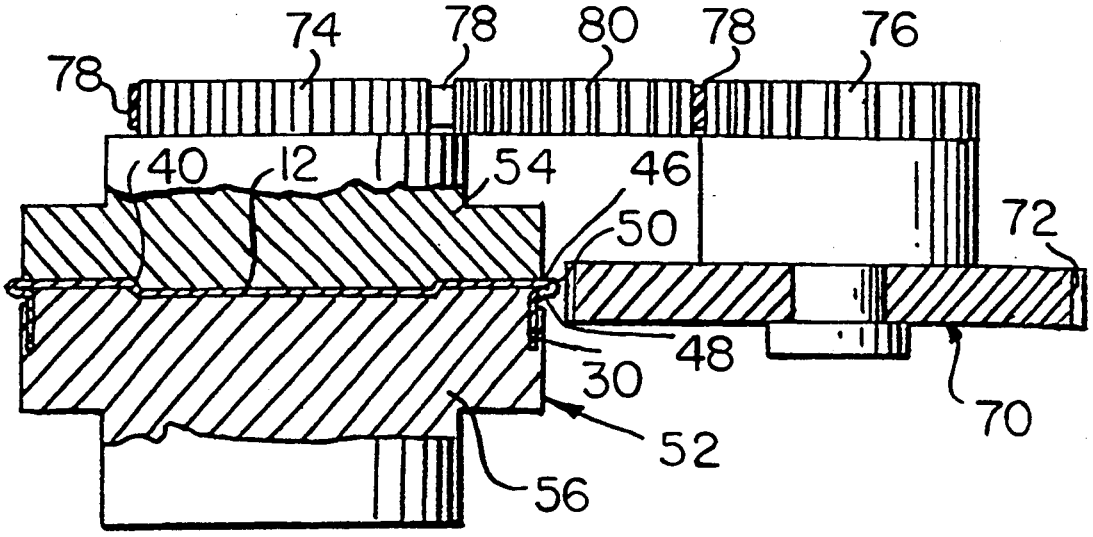
FIG. 7 is a sectional view illustrating the entire rotary holding unit and rotary tooth forming unit shown in FIG. 6.

The next cold-forming step in the present method is to cold-form a series of initially-formed teeth 17 in the thickened annular section of the preform while it is retained in secured relation with the rotary holding unit 52. FIG. 7 illustrates that the rotary holding unit 52 forms a part of a cold-forming machine capable of cold-forming the series of initially-formed teeth 17 in the annular section of the preform. The cold-forming of the series of initially-formed teeth 17 is accomplished by a rotary tooth forming tool unit, generally indicated at 70, having a tooth forming tool structure 72 on the exterior periphery thereof. The tooth forming tool structure 72 is configured so as to form teeth which are not fully formed into the final series of teeth 16. The rotary tooth forming unit 70 forms a part of a machine which provides a means for effecting a rotational movement of the rotary holding unit 52 and the rotary tooth forming tool unit 70 in a predetermined rotational relationship wherein the axes are parallel and the rotational speeds are synchronized.

Any suitable motion-transmitting means may be provided in the machine for effecting the rotational relationship. For example, as shown, the rotary holding unit 52 has a timing belt pulley 74 fixed to rotate therewith and the rotary tooth forming tool unit 72 is likewise provided with a timing belt pulley 76 which rotates therewith. A timing belt 78 is trained about the two timing belt pulleys 74 and 76 and a pair of movable idler pulleys 80 in such a way that the rotational relationship between the two rotary units 52 and 70 is maintained while permitting a relative movement between the two units and the axes thereof toward and away from one another. The timing belt 78 is of a type which includes timing teeth on both the interior and exterior surfaces thereof. The teeth on the interior periphery, as shown, are trained about the exterior periphery of the timing belt pulley 76 fixed with respect to the rotary holding unit 52 while the exterior teeth of the timing belt 78 are trained about the timing belt pulley 76 fixed to the rotary tooth forming tool unit 70. The two idler pulleys 80, which are on opposite sides of a plane passing through the axes of rotation of the two units, are movable to take up any belt configuration change as a result of the relative movement of the two units toward and away from one another with the movement of the idlers 80 being commensurate so as to maintain the synchronous rotational movement.

In this regard, it will be noted that the directions of rotation of the rotary units 52 and 70 are in opposite directions so that the tooth forming periphery 72 of the rotary tool unit 70 can be moved into meshing relation with the periphery of the annular section of the preform secured to the rotary holding unit 52. It will also be noted that the thickness of the annular section is greater than the predetermined sheet metal thickness and no greater than the predetermined distance between surfaces 64 and 66. More specifically, as shown, the thickness of the annular section is slightly greater than twice the predetermined thickness of the sheet metal but less than the predetermined distance between the tooth side forming surfaces 64 and 66.

Figure 8:
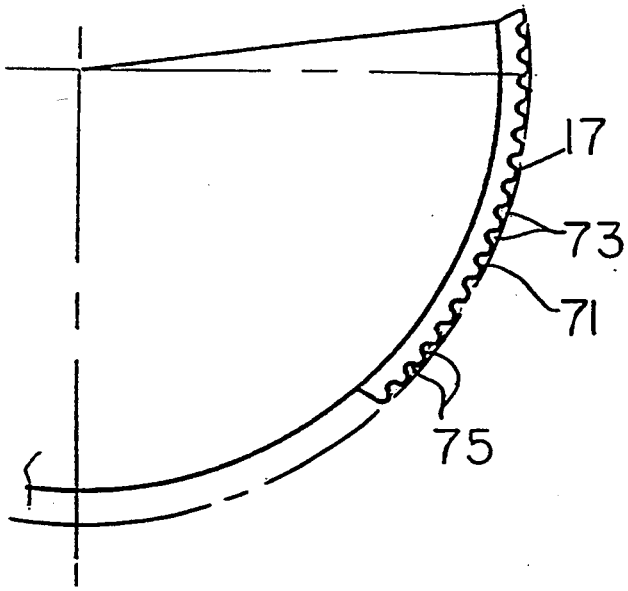
FIG. 8 is a fragmentary view of initially-formed teeth after the teeth-forming step in the method of the present invention.
Figure 9:
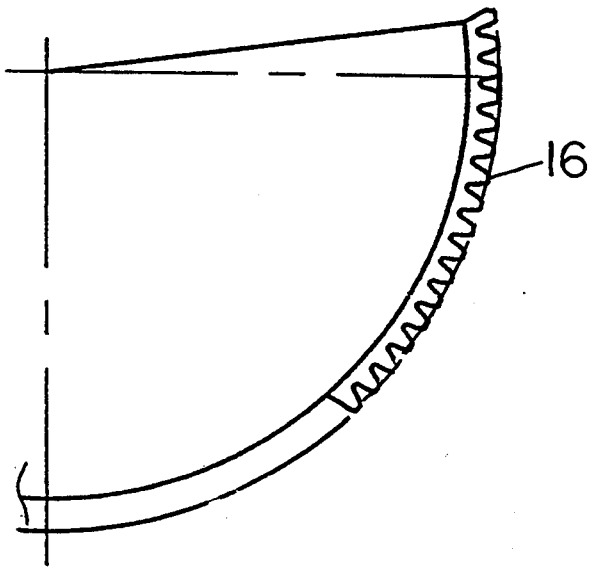
FIG. 9 is a fragmentary view of finally-formed teeth after the material removing step in the method of the present invention.

Once the predetermined rotational relationship has been established, the two rotary units 52 and. 70 will be rotated in the predetermined rotational relationship which, for example, is an identical speed in opposite directions of 150–180 revolutions per minute. With the two rotary units 52 and 70 in the position shown in FIG. 7 and while the rotational relationship is retained, a relative movement between the two rotary units and their parallel vertical axes (as viewed in FIG. 7) in a direction toward one another is effected. Preferably, the rotary tool unit 70 is moved while the axis of rotation of the rotary holding unit 52 is held stationary; although both units could be moved or only the rotary unit 52 could be moved. An exemplary feed rate of the movement of the axis of the rotary tool unit 70 toward the axis of the rotary holding unit 52 is approximately 120 mm. per minute. As the outer tool forming periphery 72 of the tool forming tool unit 70 moves to engage the periphery of the annular section of the preform in cooperating metal deforming relation inwardly of the exterior periphery thereof, the sheet metal of the annular section is cold-formed into the series of initially-formed teeth 17. As shown in FIG. 8, the teeth 17 are not fully formed into the series of final teeth 16 (FIG. 9). Preferably, this is accomplished by effecting a movement of the rotary tool unit 70 toward the holder unit to an extent which equals about four meshing turns. When this feed movement has been reached, the drive for the two units is reversed and then the feed movement is advanced until four more meshing turns are accomplished. These alternative direction feeds are repeated until the full, initially-formed series of teeth 17 has been completed.

Thus, during the infeed, the peripheries of the series of initially-formed teeth 17 are cold-formed by rolling contact with the tooth forming periphery 72 of the tooth forming tool unit 70. The tooth forming periphery 72 consists of teeth-like projections with trough-like spaces therebetween. The trough-like spaces form the initially-formed teeth on the preform and the teeth-like projections form the troughs between the initially-formed teeth on the preform. The tips of the teeth-like projections form the bottom of the troughs. It is noted that the width of the teeth-like projections is greater than the width of the teeth which are formed on the preform. During the formation of the teeth on the preform, the preform material which is initially disposed in the spaces where the troughs are finally provided is moved by the teeth-like projections of the tooth forming periphery 72 either radially inwardly into the back-up space or axially outwardly. Because of the greater width of the teeth-like projections, the axial movement must be accompanied by movements in opposite circumferential directions. This circumferential movement results in a build-up of material on both sides of the teeth being formed on the preform. This build-up of the sides of the teeth is allowed to take place on a free-forming basis in the preferred configuration of the tooth-forming periphery 72 wherein the teeth-like projections are of uniform cross-sectional configuration across their entire width. With the preferred configuration, the entire sides of the teeth of the preform are free formed.

FIG. 8 show a portion of the initially-formed teeth. Each of the teeth include a crest portion 71, a trough portion 73 and a pair of operative surfaces 75. The operative surfaces oppose each other and are disposed between the crest and trough portions.

Figure 6:
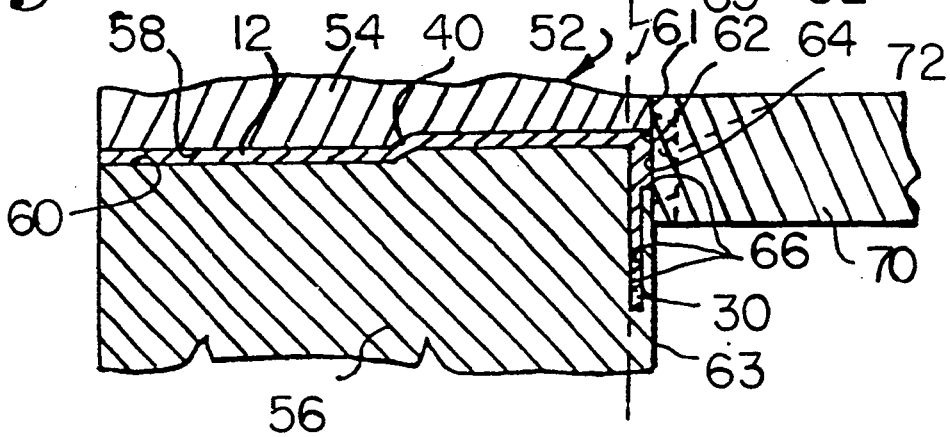
FIG. 6 is a view similar to FIG. 5 showing the teeth forming step in the method of the present invention wherein the thickened annular section of the preform is cold-formed into a series of initially-formed teeth.

FIG. 6 shows the position of the tooth-forming periphery 72 with respect to the preform at the end of the relative movement of the units toward one another. It will be noted that the back-up space is filled with preform material. In this regard, it will be noted that the portion of surface 66 which extends axially in the plane 61 limits the amount of radially inwardly movement of preform material which can occur during the formation of the teeth 17. Preferably, the limitation is enough to fill the entire back-up space in the areas of the formed teeth as well as the formed trough shown in the cross-section of FIG. 6. In its broadest aspects, the invention contemplates that some void areas, as, for example, where the teeth are, can exist within the back-up space after initial tooth formation. With the preferred embodiment as shown in FIG. 6, the filling of the back-up space results in the free-forming of the sides of the teeth 17.

It is greatly preferred that the annular section of the preform have an outer peripheral dimension which is at least as great as the crest dimension of the series of final teeth 16. However, the outer peripheral dimension may be greater than the crest dimension and then machined to the crest dimension as will become apparent below.

The next step in the method, after cold-forming the initially-formed teeth 17, is to remove the tooth forming tool unit 70 from engagement with the preform and then perform a material removal step to remove metal from the initially cold-formed teeth 17 to define the final series of teeth 16. Thus, for example, a machining operation, such as shaving or broaching may be employed to precisely cut at least the operative surfaces 75 of teeth 17 to achieve the final series of teeth 16. However, it is within the contemplation of the present invention that the final trough depth can be roll-formed and thereafter material can be removed from the operative surfaces 75 to widen the trough portion and define the final tooth configuration. Further, the final crest dimension may be cold-formed, thus, only the operative surfaces and trough portions would require machining to define the final series of teeth 16.

In the illustrated embodiment as shown in FIG. 9, material has been removed from the pair of operative surfaces 75, the crest portion 71 and the trough portion 73 of the initially-formed teeth 17 to accurately define the final series of teeth 16. Thus, the material removal step may vary depending upon the desired quality of the final series of teeth 16. Thus, if high-accuracy teeth are desired, each of the trough portions, crest portions and pair of operative surfaces is machined.

Since material is being removed from the preform to define the final series of teeth 16, it is preferable that the final thickened preform is formed so as to have slightly more material than the final thickened preforms as disclosed in the '388 and '775 applications. This will ensure that the final teeth 16 formed by removing material by the method of the present invention will be as robust as the final teeth formed by the cold-forming method alone.

In its broadest aspects, the present invention contemplates having the sides free-formed, however, preferably, the method of the present invention contemplates machining one or both of the sides of the teeth 16 so that the sides are coincident-with the desired spaced planes. In the embodiment thus far described, only the free-formed side in alignment with surface 64 is machined and the other is left free-formed with the flange 30 extending outwardly thereof. This relationship is evident from the perspective view of the completed toothed wheel 10 shown in FIG. 1.

As best shown in FIG. 1, the central wall 12 is centrally apertured, as indicated at 82, which is a cold-forming step that may be accomplished after the series of teeth 16 are defined by removal of material, or preferably, this opening is formed prior thereto. Another cold-forming step which is made after the series of teeth 16 have been cut is the stamping of the series of openings 20 of rectangular configuration at regular intervals along the remaining portion of the axial flange 30. The exterior surface of the remaining portion of the axial flange 30 is preferably machined in a lathe to form the pulse ring 18 with an accurate cylindrical exterior surface which intersects with the openings 20 to accurately provide signals at regular intervals which are used to provide computer control for the engine.

In the case of the starter gear 10 made in accordance with the above procedure, it is desirable that the final configuration be given a heat treatment at least in the area of the series of teeth 16. Preferably, the heat treatment is by induction heating to a temperature of 850° to 900° C. followed by quenching in water to room temperature. Heat treatment is considered desirable in the case of a starting gear because of the severe loads which are imposed along the volute surfaces of the teeth in operation. With the present invention, the teeth 16 can be made to be substantially solid in the central area where the load is supplied by providing enough material in the preform to insure that the back-up space is filled. However, as mentioned above, in the broadest aspect of the invention, the back-up space can have void areas.

Figure 10:
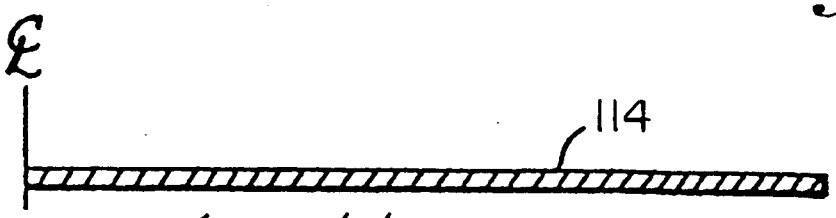
FIGS. 10–12 are views similar to FIGS. 2–6 illustrating steps in performing another embodiment of the method of the present invention.
Figure 11:
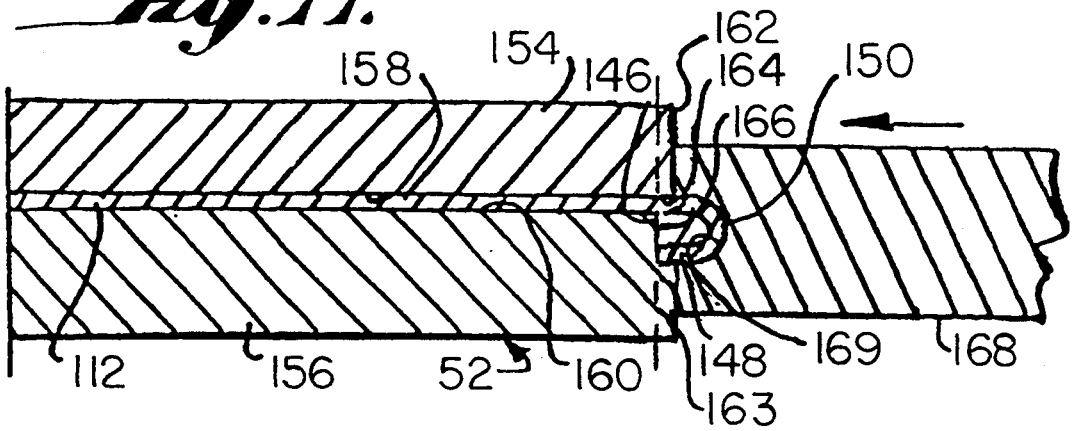
Figure 12:
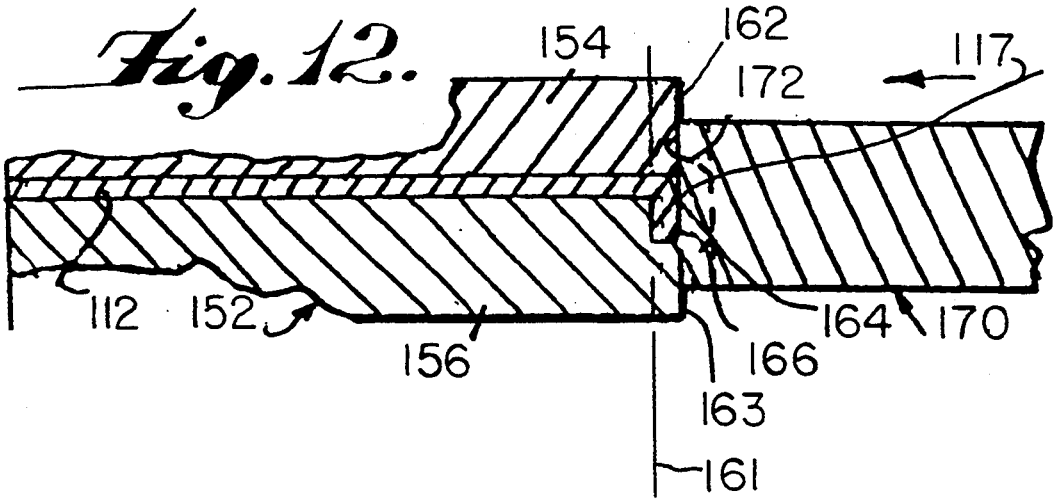

FIGS. 10–12 illustrate additional method step variations which are within the contemplation of the present invention. FIG. 10 illustrates a circular piece of sheet metal 114 of predetermined thickness which is secured in a rotary holding unit 152 of modified form including first and second annular holding members 154 and 156. As shown, the holding members 154 and 156 are formed with an inner pair of oppositely facing central wall engaging surfaces 158 and 160 which are adapted to engage the central wall 112 when in operative holding relation therewith. As before, the inner pair of surfaces 158 and 160 extend outwardly to an inner cylindrical plane 161 which is inwardly of an outer plane. As before, the holding members 154 and 156 include outwardly facing exterior peripheral surfaces 162 and 163, respectively, which define the outer plane. An outer pair of surfaces 164 and 166 respectively extend from the surfaces 158 and 160 in plane 161 to the surfaces 162 and 163, respectively, so as to define a back-up space between the plane 161 and the outer plane.

The holding members 154 and 156 in operative holding relation cooperate with a rotary preform rolling member 168 having a U-shaped groove 169 formed in its outer periphery. By advancing the rotary preform rolling member 168 with respect to the rotary holding unit 152 in a manner similar to the rotary member 68 previously described, an outer annulus of the circular piece 114 extending radially outwardly beyond the surface 162 is cold-formed into a peripheral flange extending outwardly and then downwardly from a curved control portion so as to provide a cross-sectional configuration which opens generally radially inwardly. While final configuration of the annular section which is cold-formed by the preform rolling member 168 could be of inverted semi-circular shape, the configuration is more of an inverted U-shape having a pair of side-by-side annular wall portions 146 and 148 integrally interconnected by a central arcuate transitional wall portion 150.

It will be understood that the annular section provided by wall portions 146, 148, and 150 could be thickened by utilizing a thickening tool similar to the tool 68; however, in the method according to FIGS. 10–12, the next step is to cold-form the annular section into a series of initially-formed teeth 117. This is accomplished by a rotary tooth forming tool unit 170 which is constructed and operated like the rotary tooth forming tool unit 70 to include a tooth forming periphery 172. The tool unit 170 is operated in the same manner as indicated before with at least portions of the sides of the teeth being free formed and the back-up space preferably filled with steel material, as is shown in FIG. 12. The final series of teeth 116 are then cut in the same manner as above. The finished toothed wheel in this embodiment is preferably machined along both of the side defining planes which are aligned with surfaces 164 and 166.

Referring now more particularly to FIGS. 13–16, there is shown therein another variation in the process according to the present invention. In this variation, the sides of the initially-formed teeth 17 are not free-formed.

FIG. 13 illustrates a circular piece of sheet metal 214 of predetermined thickness which is secured in a rotary holding unit 252 of modified form including first and second annular holding members 254 and 256. As shown, the holding member 256 is formed with outwardly facing cylindrical control surface 258 which extends generally axially from a central portion of the circular piece of sheet metal 214 at the outer periphery thereof which defines the central wall 212 of the finished product. The holding members 254 and 256 cooperate with a rotary preform rolling member 268 having a U-shaped groove 269 formed in its outer periphery.

By advancing the rotary preform rolling member 268 with respect to the rotary holding unit 252 in a manner similar to the rotary member 168 previously described, an outer annulus of the circular piece 214 extending radially outwardly beyond the control surface 258 is cold-formed into a peripheral flange extending outwardly and then downwardly from a curved control portion so as to provide a cross-sectional configuration which opens generally radially inwardly. The final configuration of the annular section which is cold-formed by the preform rolling member 268. While it could be of inverted semi-circular shape is more of inverted U-shaped configuration having a pair of side-by-side annular wall portions 246 and 248 integrally interconnected by a central arcuate transitional wall portion 250.

In the method according to FIGS. 13–15, the next step is to cold-form the annular section into a series of initially-formed teeth 217. This is accomplished by a rotary tooth forming tool unit 270 which is constructed and operated similar to the rotary tooth forming tool unit 70 except that, in addition to a tooth forming periphery 272, the tool unit includes a pair of flanges 260 and 262 extending generally radially outwardly on opposite sides of the tooth forming periphery 270. The flanges 260 and 262 have smooth planar oppositely facing radially extending tooth-side forming surfaces 264 and 266.

Thus, during the infeed as described above, the peripheries of the series of initially-formed teeth 217 are cold-formed by rolling contact with the tooth forming periphery 272 of the tooth forming tool unit 270 and portions of the sides of the series of teeth 217 are cold-formed by contact with the smooth tooth side forming surfaces 264 and 266 of the flanges 260 and 262 so that an amount of sheet metal which would otherwise uncontrollably flow axially outwardly of the smooth tooth-side forming surfaces is concentrated within the teeth and/or the radially inward back-up therefor.

The resultant tooth sides are formed by a relative sliding contact with the surfaces 264 and 266. While the tooth side forming surfaces 264 and 266 are shown as being parallel, they-can be planar or smoothly curved surfaces which diverge outwardly with respect to one another.

After cold forming the initially-formed teeth 217, the final series of teeth 16 (FIG. 9) are cut in a manner similar to that described above.

It thus will be seen that the objects of this invention have been fully and effectively accomplished. It will be realized, however, that the foregoing preferred specific embodiment has been shown and described for the purpose of this invention and is subject to change without departure from such principles. Therefore, this invention includes all modifications encompassed within the spirit and scope of the following claims.

What is claimed is:

1. A method of forming a one-piece sheet metal toothed wheel including a central sheet metal wall of predetermined thickness and a series of integral teeth on the periphery of the central wall, said method utilizing (1) a rotary holding unit, and (2) a rotary tooth-forming tool unit having a rotational axis and a tooth-forming periphery extending annularly about said rotational axis, said method comprising the steps of:

cold-forming a circular piece of sheet metal into a preform having an outer annular section of generally uniform cross-sectional configuration and an integral sheet metal central wall generally of said predetermined thickness extending generally inwardly from the outer annular section toward a preform axis, said Outer annular section having (1) a width greater than said predetermined thickness, and (2) an outer periphery which will allow a meshing action with the tooth-forming periphery of the tooth-forming tool unit, rotating (1) said rotary holding unit with said preform secured thereto about the preform axis, and (2) said tooth-forming tool unit about the rotational axis thereof in a predetermined rotational relation wherein said axes are parallel and the rotational speeds are synchronized, while said rotary holding unit with said preform secured thereto and said tooth-forming tool unit are in said predetermined rotational relation, affecting a relative movement between said units and the axes thereof in a direction toward one another to engage the tooth-forming periphery of the tooth-forming tool unit in cooperating metal-deforming relation until the sheet metal of the outer portion of the annular section is cold-formed into a series of initially-formed teeth, peripheries of said series of initially-formed teeth being cold-formed by rolling contact with the tooth-forming periphery of the tooth-forming tool unit, each of said initially-formed teeth having a crest portion, a trough portion and a pair of oppositely disposed operative surfaces defined between said crest portion and said trough portion, and forming said series of integral teeth by removing material from said pair of operative surfaces.

2. The method as claimed in claim 1, wherein the step of forming said series of integral teeth includes removing material from said crest portion and said trough portion.

3. The method as claimed in claim 1, wherein the step of forming said series of integral teeth includes broaching said operative surfaces.

4. The method as claimed in claim 1, wherein the step of forming said series of integral teeth includes shaving said operative surfaces.

5. The method as claimed in claim 1, wherein the initially-formed teeth are defined by troughs extending radially inwardly therebetween, said rotary holding unit providing, when in holding relation, an inner pair of opposed central wall-engaging surfaces extending generally radially outwardly to a cylindrical inner plane spaced inwardly from an outer cylindrical plane and an outer pair of back-up surfaces extending from said inner pair of opposed central wall-engaging surfaces at said inner plane to said outer plane where said outer pair of surfaces are spaced apart a predetermined distance which is greater than the spacing between said inner pair of surfaces so as to define a back-up space within an annulus between said inner and outer planes, the step of cold-forming the circular piece includes forming said outer annular section so that said width is no greater than said predetermined distance, said annular section having an outer periphery extending beyond said outer plane, the step of rotating said rotary holding unit with said preform secured thereto includes ensuring that an inner portion of said outer annular section is within said back-up space and an outer portion of said outer annular section extends radially outwardly of said back-up space, the step of affecting a relative movement between said units and the axes thereof in a direction toward one another to engage the tooth-forming periphery of the tooth-forming tool unit includes effecting a movement such that the tooth-forming periphery of the tooth-forming tool unit is in cooperating metal-deforming relation with the outer portion of said outer annular section inwardly of the exterior periphery thereof until the sheet metal of the outer portion of the annular section is cold-formed into said series of initially-formed teeth and displaced from the troughs therebetween so that after the series of initially-formed teeth are cold-formed, the toothed wheel includes a back-up portion having surfaces conforming to an outer extent of each of said outer pair of surfaces defining said back-up space, and the sides of the series of initially-formed teeth include portions being free-formed without surface contact by the axially outward movement of the metal defining the outer portion of said outer annular section.

6. A method as defined in claim 5 wherein said preform is formed by cold-forming a first annular wall portion in side-by-side relation to a second annular wall portion integral with a central portion of the circular piece of sheet metal so that the two side-by-side annular wall portions are integrally interconnected at their outer peripheries so as to form a non-thickened preform.

7. A method as defined in claim 6 wherein said non-thickened preform is cold-formed into a thickened final preform while secured to said rotary holding unit with said first annular wall portion overlying the back-up space by cold-rolling the integrally interconnected outer peripheries of said two side-by-side annular wall portions radially inwardly to thicken the outer portion of the annular wall portions and the integral interconnection therebetween.

8. The method as claimed in claim 1, wherein said initially-formed teeth have sides spaced apart a predetermined distance, said rotary holding unit has structure providing generally radially outwardly facing control surface means, and said rotary units include two annular flanges extending outwardly having two smooth tooth-side forming surface means facing toward one another spaced apart said predetermined distance, the step of cold-forming the circular piece of sheet metal includes forming the annular section so that the width thereof is no greater than said predetermined distance, the step of rotating said rotary holding unit with said preform secured thereto includes positioning said control surface means so as to underlay at least a portion of said annular section, and the step of affecting a relative movement between said units and the axes thereof in a direction toward one another to engage the tooth-forming periphery of the tooth-forming tool unit is performed with said annular section inwardly of the exterior periphery thereof until the sheet metal of the annular portion is cold-formed into said series of initially-formed teeth, portions of the sides of said initially-formed teeth being smooth and cold-formed by contact with said smooth tooth-side forming surface means so that an amount of sheet metal which would otherwise uncontrollably flow axially outwardly of the smooth tooth-side forming surface means is concentrated within the teeth and/or the radially inward back-up therefor.

9. A method as defined in claim 1 wherein at the end of the relative movement between said units towards one another to engage the tooth forming periphery of the tooth forming tool unit in cooperating relation with the outer portion of said outer annular section, the tooth forming periphery includes trough forming teeth-like projections.

10. A method of forming a one-piece sheet metal toothed wheel including a central sheet metal wall of predetermined thickness and a series of integral teeth on the periphery of the central wall, said integral teeth being formed from a series of initially-formed teeth defined by troughs extending radially inwardly therebetween, said series of integral teeth having an operative width defined by spaced tooth side defining planes, said method utilizing (1) a rotary holding unit which provides, when in holding relation, an inner pair of opposed central wall-engaging surfaces extending generally radially outwardly to a cylindrical inner plane spaced inwardly from an outer cylindrical plane concentric with an axis of the central wall and an outer pair of back-up surfaces extending from said inner pair of opposed central wall-engaging surfaces at said inner plane to said outer plane where said outer pair of surfaces are spaced apart a predetermined distance which is greater than the spacing between said inner pair of surfaces so as to define a back-up space within an annulus between said inner and outer planes and (2) a rotary tooth-forming tool unit having a rotational axis and a tooth-forming periphery extending annularly about said rotational axis, said method comprising the steps of:

cold-forming a circular piece of sheet metal into a preform having an outer annular section of generally uniform cross-sectional configuration and an integral sheet metal central wall generally of said predetermined thickness extending generally radially inwardly from the outer annular section toward a preform axis, said outer annular section having (1) a width greater than said predetermined thickness but no greater than said predetermined distance, and (2) an outer periphery extending beyond said outer plane which will allow a meshing action with the tooth-forming periphery of the tooth-forming tool unit, rotating (1) said rotary holding unit with said preform secured thereto about the preform axis and an inner portion of said outer annular section within said back-up space and an outer portion of said outer annular section extending radially outwardly of said back-up space, and (2) said tooth-forming tool unit about the rotational axis thereof in a predetermined rotational relation wherein said axes are parallel and the rotational speeds are synchronized, while said rotary holding unit with said preform secured thereto and said tooth-forming tool unit are in said predetermined rotational relation affecting a relative movement between said units and the axes thereof in a direction toward one another to engage the tooth-forming periphery of the tooth-forming tool unit in cooperating metal-deforming relation with the outer portion of said outer annular section inwardly of the exterior periphery thereof until the sheet metal of the outer portion of the annular section is cold-formed into said series of initially-formed teeth and displaced from the troughs therebetween so that after the series of initially-formed teeth are cold-formed, each of said initially-formed teeth having a crest portion, a trough portion and a pair of oppositely disposed operative surfaces defined between said crest portion and said trough portion, the toothed wheel includes a back-up portion having surfaces conforming to an outer extent of each of said outer pair of surfaces defining said back-up space, the peripheries of said series of teeth being cold-formed by rolling contact with the tooth-forming periphery of the tooth-forming tool unit and the sides of the series of teeth including portions disposed outwardly beyond said spaced tooth side defining planes being free-formed without surface contact by the axially outward movement of the metal defining the outer portion of said outer annular section, and forming said series of integral teeth by removing material from said pair of operative surfaces.

11. The method as claimed in claim 10, wherein the step of forming said series of integral teeth includes removing material from said crest portion and said trough portion.

12. The method as claimed in claim 10, wherein the step of forming said series of integral teeth includes broaching said operative surface.

13. The method as claimed in claim 10, wherein the step of forming said series of integral teeth includes shaving said operative surface.

14. A method as defined in claim 10 wherein at the end of the relative movement between said units towards one another to engage the tooth forming periphery of the tooth forming tool unit in cooperating relation with the outer portion of said outer annular section, the tooth forming periphery includes trough forming teeth-like projections.

15. A method as defined in claim 10 wherein the spaced tooth side defining planes pass generally through the outer pair of surfaces spaced apart within said outer plane and the free-formed portions of the sides of said series of integral teeth at least along one common side are machined so that the machined sides of the integral teeth on said one common side are disposed in a common plane constituting one of said spaced tooth side defining planes.

16. A method as defined in claim 15 wherein the free-formed portions of both sides of said series of integral teeth are machined in common planes constituting both of said spaced tooth side defining planes.

17. A method as defined in claim 10 wherein said preform is formed by cold-forming a first annular wall portion in side-by-side relation to a second annular wall portion integral with a central portion of the circular piece of sheet metal so that the two side-by-side annular wall portions are integrally interconnected at their outer peripheries so as to form a non-thickened preform.

18. A method as defined in claim 17 wherein said non-thickened preform is cold-formed into a thickened final preform while secured to said rotary holding unit with said first annular wall portion overlying the back-up space by cold-rolling the integrally interconnected outer peripheries of said two side-by-side annular wall portions radially inwardly to thicken the outer portion of the annular wall portions and the integral interconnection therebetween.

19. A method as claimed in claim 18 wherein said non-thickened preform is formed by cold-forming an outer annular portion of the circular piece of sheet metal into a peripheral flange extending axially from a central portion thereof, cold-forming a portion of the peripheral flange into said two side-by-side annular wall portions integrally extending outwardly of a remaining portion of said peripheral flange, said central portion providing said central wall, said pair of side-by-side integrally interconnected annular wall portions providing said annular section, and the remaining portion of the peripheral flange providing a pulse ring.

20. A method as claimed in claim 19 wherein said predetermined rotational relation includes a simultaneous synchronous rotation of said units in opposite directional meshing engagement to one another through a multiplicity of revolutions including reversal of directions.

21. A method of forming a toothed wheel including a series of integral peripheral teeth, said teeth having sides spaced apart a predetermined distance utilizing (1) a rotary holding unit having structure providing generally radially outwardly facing control surface means, and (2) a rotary tooth-forming tool unit having a rotational axis and a tooth-forming periphery extending annularly about said rotational axis, said rotary units including two annular flanges extending outwardly thereof having two smooth tooth-side forming surface means facing toward one another spaced apart said predetermined distance, said method comprising the steps of:

cold-forming a circular piece of sheet metal of predetermined thickness into a preform having an outer annular section of generally uniform cross-sectional configuration and an integral sheet metal central wall generally of said predetermined thickness extending annularly inwardly from the outer annular section toward a preform axis, said outer annular section having (1) a width greater than said predetermined thickness but no greater than said predetermined distance, and (2) an outer periphery which will allow a meshing action with the tooth-forming periphery of the tooth-forming tool unit, rotating (1) said rotary holding unit with said preform secured thereto about the preform axis and with said control surface means underlying at least a portion of said annular section and (2) said tooth-forming tool unit about the rotational axis thereof in a predetermined rotational relation wherein said axes are parallel and the rotational speeds are synchronized, while said rotary holding unit with said preform secured thereto and said tooth-forming tool unit are in said predetermined rotational relation effecting a relative movement between said units and the axes thereof in a direction toward one another to engage the tooth-forming periphery of the tooth-forming tool unit in cooperating metal-deforming relation with said annular section inwardly of the exterior periphery thereof until the sheet metal of the annular section is cold-formed into said series of initially-formed teeth, the peripheries of which are cold-formed by rolling contact with the tooth-forming periphery of the tooth-forming tool unit and portions of the sides of which are smooth and cold-formed by contact with said smooth tooth-side forming surface means so that an amount of sheet metal which would otherwise uncontrollably flow axially outwardly of the smooth tooth-side forming surface means is concentrated within the teeth and/or the radially inward back-up therefor, each of said initially-formed teeth having a crest portion, a trough portion and a pair of oppositely disposed operative surfaces defined between said crest portion and Said trough portion, and forming said series of integral teeth by removing material from said pair of operative surfaces.

22. The method as claimed in claim 21, wherein the step of forming said series of integral teeth includes removing material from said crest portion and said trough portion.

23. The method as claimed in claim 21, wherein the step of forming said series of integral peripheral teeth includes broaching said operative surfaces.

24. The method as claimed in claim 21, wherein the step of forming said series of integral peripheral teeth includes shaving said operative surfaces.

25. A method as defined in claim 21 wherein said preform is cold-formed into its final configuration while secured to said rotary holding unit and at least a portion of said control surface means is contacted by at least a portion of said annular section during the cold-forming of said preform.

26. A method as defined in claim 25 wherein said outwardly facing control surface means includes a pair of annular control surfaces extending axially in opposite directions from an outer periphery of the central wall of the preform and radially within overlying portions of said annular section so that during the cold-forming of the series of initially-formed teeth radial inward movement of the overlying portions of the annular section is controlled by engagement with said pair of annular control surfaces.

27. A method as defined in claim 26 wherein the circular piece of sheet metal is cold-formed into said preform while secured with the rotary holding unit by cold-rolling an outer annulus of the circular piece of sheet metal radially inwardly to an extent sufficient to thicken the outer annulus into said annular section having two portions contacting said pair of control surfaces.

28. A method as defined in claim 27 wherein said pair of annular control surfaces are cylindrical and are in pressure contact control of the overlying portions of said annular section at the end of the cold-forming of the series of initially-formed teeth.

* * * * *